US011834891B2

(12) United States Patent
Sanchez Burger et al.

(10) Patent No.: US 11,834,891 B2
(45) Date of Patent: Dec. 5, 2023

(54) SPACER DEVICE

(71) Applicant: ILLINOIS TOOL WORKS INC., Glenview, IL (US)

(72) Inventors: Sven Sanchez Burger, Ingolstadt (DE); Moritz Heilek, Baar-Ebenhausen (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/725,282

(22) Filed: Apr. 20, 2022

(65) Prior Publication Data

US 2022/0341235 A1 Oct. 27, 2022

(30) Foreign Application Priority Data

Apr. 23, 2021 (DE) ..... 102021110505.6
Apr. 7, 2022 (DE) ..... 102022108487.6

(51) Int. Cl.
*E05F 5/02* (2006.01)

(52) U.S. Cl.
CPC ..... *E05F 5/022* (2013.01); *E05Y 2201/224* (2013.01); *E05Y 2600/12* (2013.01); *E05Y 2600/314* (2013.01); *E05Y 2900/536* (2013.01); *E05Y 2900/546* (2013.01); *E05Y 2900/548* (2013.01)

(58) Field of Classification Search
CPC ..... E05F 5/022; E05Y 2201/224; E05Y 2600/12; E05Y 2600/314; E05Y 2900/536; E05Y 2900/546; E05Y 2900/548
See application file for complete search history.

(56) References Cited

U.S. PATENT DOCUMENTS 6,088,878 A * 7/2000 Antonucci ..... E05F 5/022 24/297
6,119,306 A * 9/2000 Antonucci ..... E05F 5/022 24/297
8,291,547 B2 * 10/2012 Ukai ..... F16B 21/086 267/141

(Continued)

FOREIGN PATENT DOCUMENTS

DE 4011186 A 10/1990
DE 102011101393 A1 * 11/2012 ..... E05F 5/022

(Continued)

*Primary Examiner* — Victor D Batson
*Assistant Examiner* — Matthew J Sullivan
(74) *Attorney, Agent, or Firm* — THOMPSON HINE LLP

(57) ABSTRACT

A spacer apparatus includes: a tubular base element having a sheath wall and a flange-like bottom wall portion. An inner wall portion of the sheath wall bounds a receiving space and an outer threading is integrally formed on an outer wall portion of the sheath wall. A pin passage is configured in the bottom wall. A fastening device is provided on the side of the bottom wall opposite the sheath wall for connecting the spacer apparatus to a carrier component. The spacer apparatus includes a pin element arranged in the receiving space for actuating the fastening device, which pin element extends through the pin passage, and a bowl-shaped stopper cap having an inner threading that is engaged with the outer threading and a stopper wall extending orthogonally to an axial direction. The stopper cap and the fastening device are approximately flush with one another in the axial direction.

12 Claims, 4 Drawing Sheets

(56) References Cited

U.S. PATENT DOCUMENTS

| | | | | |
|---|---|---|---|---|
| 9,212,512 | B2 * | 12/2015 | Nakasone | F16F 1/128 |
| 10,047,818 | B2 * | 8/2018 | Nakasone | F16F 13/005 |
| 10,150,444 | B1 * | 12/2018 | Schwalm | E05F 5/02 |
| 10,570,655 | B2 * | 2/2020 | Nakasone | E05C 19/16 |
| 10,619,394 | B2 * | 4/2020 | Bell | B60J 5/107 |
| 10,689,894 | B2 * | 6/2020 | Diez Herrera | E05F 5/025 |
| 10,934,758 | B2 * | 3/2021 | Cahill | B62D 65/02 |
| 11,066,863 | B2 * | 7/2021 | de Marco | E05F 5/025 |
| 11,421,462 | B2 * | 8/2022 | Gardynik | E05F 5/022 |
| 11,585,139 | B2 * | 2/2023 | Nakamaru | E05F 3/10 |
| 2006/0101615 | A1 * | 5/2006 | Pinzl | E05F 5/022 16/82 |
| 2022/0333421 | A1 * | 10/2022 | Kwak | E05F 5/022 |

FOREIGN PATENT DOCUMENTS

| | | |
|---|---|---|
| EP | 0611868 | 8/1994 |
| WO | WO 2018/063847 A1 | 4/2018 |

* cited by examiner

SPACER DEVICE

TECHNICAL FIELD

The present invention relates to a spacer apparatus for arranging two components so as to be spaced apart from one another or at a distance from one another.

BACKGROUND

DE 40 11 186 discloses a stopper for an engine hood of a motor vehicle. The stopper consists of a base having a left-handed inner threading that receives a threaded bushing. A pin has a rounded head that is fastened by means of a split screw. The screw has a right-hand threading with a tip that causes a flaring of the split body in such a way that it engages into the base. This characteristic feature allows an adjustment in the axial direction after the stopper has been attached to the hood.

EP-A-611868 describes a three-piece adjustable stopper with a carrier, an axially adjustable stopper element arranged in a cavity of the carrier, and a rotatable securing element that can be operated in order to lock the stopper element in a preferred position.

WO 2018/063847 A1 provides an adjustable stopper element. A stopper element and a fastening element are arranged at an offset from one another by 90°.

SUMMARY

The problem addressed by the present invention is to further improve spacer apparatuses known from the prior art and/or to provide an alternative to spacer apparatuses known from the prior art.

A further problem addressed by the present invention is to provide a transport securing system for spacer apparatuses.

In addition, a problem addressed by the present invention is to provide a spacer apparatus whose components are fixed in an output or transport securing position relative to one another.

One or more of these problems are solved by the features of independent claim 1. Advantageous configurations are specified in the respective dependent subclaims.

According to the invention, a spacer apparatus is provided. This includes a base element having a tubular sheath wall and a bottom wall, wherein an inner wall portion of the sheath wall bounds a receiving space, and wherein a pin passage is configured in the bottom wall, wherein a fastening device is provided on the side of the bottom wall opposite the sheath wall for connecting the spacer apparatus to a carrier component, a pin element arranged in the receiving space for actuating the fastening device that extends through the pin passage, and a stopper element, wherein the stopper element and the sheath wall of the base element are rotatably connected to one another via a threaded connection.

The bottom wall can be flange-like in configuration.

A first threading, preferably an outer threading, can be integrally formed on a wall portion, preferably an outer wall portion, of the sheath wall.

The stopper element can comprise a second threading, preferably an inner threading, which is engaged with the first threading, preferably an outer threading, of the base element.

The stopper element comprises a stopper wall, which preferably extends orthogonally to an axial direction, wherein the stopper element and the fastening device can be arranged so as to be approximately flush in the axial direction.

The threaded connection can be configured in such a way that the sheath wall of the base element has a first threading and the stopper element has a second threading. The first threading can be configured as an outer threading on an outer wall portion of the sheath wall of the base element, and the second threading can be configured as an inner threading on an inner wall portion of the stopper element. Conversely, it is also possible for the first threading to be configured as an inner threading on an inner wall portion of the sheath wall of the base element and for the second threading to be configured as an outer threading on an outer wall portion of the stopper element.

The stopper element is preferably configured as a bowl-shaped stopper cap. However, the stopper element can also be cylindrical, tubular, rectangular, or pin-like in configuration, wherein a stopper surface extending approximately orthogonally to an axial direction is always provided.

The spacer apparatus according to the present invention has been developed in particular with a view to application in the automotive sector. Adjustable spacer apparatuses are used, for example, in order to dampen and reduce vibrations of parts to be opened, for example, a trunk flap or a hood.

Spacers are tasked with supporting a movable structural carrier component (for example, a trunk flap or hood of a vehicle) in a position that is flush with the fixed structural carrier component (for example, the body of a vehicle). For example, the relative distance between the two structural parts can vary due to manufacturing and assembly tolerances. There is therefore a need for adjustable spacer apparatuses that allow for a compensation of the manufacturing and assembly tolerances between two components. According to the present invention, such a spacer apparatus is thus provided for the first time, in which the stopper cap and the fastening device are arranged so as to be approximately flush with one another in the axial direction.

The stopper cap constitutes an adjustable tolerance compensation element.

The spacer apparatus is configured so as to be assembled in a carrier component in an assembly direction, wherein an assembly direction is understood to be a direction approximately orthogonal to a surface of a carrier component in which a corresponding spacer apparatus is inserted or attached thereto. The assembly direction approximately corresponds to the axial direction or is parallel to the axial direction.

In particular, at least one and preferably two diametrically opposed positioning means, which are configured in the manner of a latching element and extend into the receiving space in the axial direction, can be arranged on the bottom wall. The stopper cap can comprise an outer sheath wall, on which the inner threading is integrally formed, and a tubular inner positioning wall arranged concentrically to the outer sheath wall. Positioning recesses, which are configured so as to be radially circumferential and so as to correspond to the positioning means, are arranged on an inner wall of the tubular positioning wall in order to secure the stopper element against a rotation relative to the base element.

By providing at least one positioning means on the bottom wall of the base element and at least one correspondingly configured positioning recess in the stopper cap, an anti-rotation or transport securing feature is formed, which prevents the stopper cap from rotating relative to the base element or secures a preset arrangement of the stopper cap on the base element.

In this way, in a home or transport position, a rotation of the stopper cap relative to the base element is securely and reliably prevented. Thus, already after the manufacture of the spacer apparatus, a desired distance i.e., a predetermined spacing from the bottom wall to the stopper wall of the spacer apparatus can be preset. This is then securely and reliably maintained when the spacer apparatus is delivered as an assembly to a customer.

Then, with correspondingly accurate manufacturing tolerances, no fine adjustment of the stopper cap is necessary. It is then entirely sufficient to connect the spacer apparatus to a carrier component, in particular a motor vehicle, by means of the fastening device. Each spacer then has a predetermined, desired preset distance between the bottom wall and the stopper wall. Thus, only one assembly step is necessary, in which the fastening device is fixed by means of the pin element and the spacer apparatus is connected to a carrier component.

The positioning means can be approximately L-shaped, wherein a long leg of the positioning means extends in the axial direction and an orthogonally extending short leg of the positioning means is configured in the manner of a latch element at its free end, in order to engage into a corresponding positioning recess.

A fine adjustment of a distance between the stopper wall and the bottom wall can be finely adjusted by a rotational movement of the stopper cap about a longitudinal axis of the spacer apparatus.

Thus, a relative position between the stopper cap and the base element is fixed in place by the positioning means and the positioning recess.

The fastening device can be configured by spreading vanes arranged so as to be radially circumferential about the pin passage, which vanes can be spreadable by means of the pin element. Preferably, three to five and preferably four spreading vanes can be provided. The spreading vanes can form an approximately rectangular and preferably square anti-rotation portion in the region of the bottom wall. Latching elements extending radially outward can preferably be integrally formed on the spreading vanes in order to hold the spacer apparatus in a pre-assembly position in a carrier component.

By a displacement of the pin element in the axial direction towards the spreading vanes, the spreading vanes are spread and secure the spacer apparatus in a passage of a carrier component.

In this way, a simple and secure assembly of the spacer apparatus in a carrier component is possible.

In conjunction with the pin element, the spreading vanes form a type of spreading rivet.

Due to the fact that the spreading vanes form an approximately rectangular and preferably square anti-rotation portion in the region of the bottom wall, the spacer apparatus is held in the carrier component in a rotation-proof manner in such a way that, when the stopper cap is adjusted or rotated, the spacer apparatus or its base element is held in the carrier component in a rotation-proof manner.

By providing radially outwardly extending latching elements on the spreading vanes, a pre-assembly position of the spacer apparatus can be secured in a carrier component in which the spacer apparatus is held with the carrier component via the latching elements. In addition, the advantage here is that if an employee forgets to actuate the fastening device, the spacer apparatus is still held in the carrier component.

The pin element can comprise a head portion and a shaft portion, wherein an actuation surface extending orthogonally to the axial direction is provided on the head portion in order to displace the pin element in the axial direction.

The actuation surface can be subjected to a force in the axial direction by means of a tool in such a way that the pin element can be displaced in the axial direction.

In addition, a recess, preferably a (pass-through) recess, extending orthogonally to the axial direction can be configured in the head portion in order to detach the fastening device by means of a tool.

By providing the recess for removing the fastening device, the spacer apparatus can be disassembled by unscrewing the stopper cap so that the receiving space is exposed. Then, a tool is laterally inserted into the recess and the pin element is subjected to a force in the axial direction in such a way that the pin element is disengaged from the spreading vanes of the fastening device, and the spacer apparatus can be disassembled.

In a transition region from the head portion to the shaft portion, a radially circumferential circular disk-shaped sealing portion can be provided.

In addition, an approximately cylindrical guiding portion can be provided adjacent the sealing portion for guiding the pin element in the pin passage.

On the one hand, a secure and reliable guiding of the pin element is ensured by the guiding portion when displacing in the axial direction. On the other hand, water is kept away from the pin passage.

Adjacent to the securing portion, a transport securing portion can be provided for securing a transport or home position of a pin element.

Furthermore, a cone-shaped insert portion can be provided adjacent the transport securing portion.

The insert portion of the pin element facilitates insertion of the pin element into the pin passage upon an initial assembly of the spacer apparatus. In addition, the insert portion facilitates spreading of the spreading vanes of the fastening device.

An actuation passage can be configured centrally in the stopper surface in order to displace the pin element in the axial direction by means of a tool, wherein the actuation passage is preferably bounded by an annular portion extending into the receiving space, and wherein the head portion of the pin element in the home position is preferably arranged regionally in the actuation passage, and the actuation passage preferably forms a drive.

The drive can preferably be configured as an Allen drive in such a way that the tool, with which the actuation surface of the pin element is subjected to a force in the axial direction, is preferably an Allen key.

In addition, the actuation opening can be used by means of the Allen drive in order to rotate the stopper cap about a longitudinal axis and thus to perform a fine adjustment or a readjustment of the spacer apparatus with respect to the spacing of the bottom wall and the stopper surface.

The drive can alternatively also be configured on an outer sheath wall of the stopper element or the stopper cap, for example as an external hexagon.

A sealing ring can be arranged on the bottom wall in the receiving space so as to be radially circumferential about the pin passage, to which sealing ring the sealing portion of the pin element abuts sealingly in an assembly position, and/or wherein a sealing lip extending radially circumferentially in the axial direction is integrally formed on the side of the bottom wall opposite the sheath wall, wherein the sealing ring and the sealing lip are formed from a soft component and are preferably manufactured together with the base element by means of a 2-component injection molding process.

By providing a sealing ring, the pin passage is sealed in cooperation with the annular disk-shaped sealing portion of the pin element.

By providing the sealing lip, the bottom wall of the spacer apparatus is configured to be splash-tight or, optionally, even water-tight against a surface of a carrier component to which the spacer apparatus is connected. In this way, the penetration of water, for example rain water or melt water, is prevented, and a carrier component is protected against corrosion.

By means of a corresponding 2-component injection molding process, the base element can be manufactured in a simple manner.

Furthermore, the sealing ring can preferably be connected to the bottom wall via a tubular guiding element bounding the pin passage, in that the guiding portion of the pin element is guided during the transition from the transport position into the assembly position. By means of the tubular guiding element, the pin element is guided securely and reliably when displaced in the axial direction.

By providing the guiding element in the region of the pin passage, water is prevented from running towards the sealing ring or towards the pin passage. In this way, water that penetrates the spacer apparatus can be securely and reliably discharged, thereby avoiding corrosion.

The transport securing portion of the pin element can comprise securing blades that are radially circumferential and equally spaced apart from one another and extend in the axial direction, wherein the securing blades are arranged in the transport position between the spreading vanes of the fastening device and secure the pin element against a displacement in the axial direction, and wherein the number of securing blades corresponds to the number of spreading vanes.

By the securing blades, an unintended displacement of the pin element in the axial direction relative to the base element is prevented. Furthermore, by arranging the securing blades in the region between the spreading vanes, they are secured against damage during transport and against undesired bending.

Regions of the outer threading of the base element that are arranged flush in the axial direction can have a pitch that is different from the remaining outer threading, in such a way that curved portions are configured in the outer threading in order to tense the inner threading of the stopper element with the outer threading of the base element.

Normal threading, in particular plastic threading, always has some tolerance or play in the axial direction. By means of the curved portions, this play is avoided, and the stopper cap is tensed with the outer threading of the base element.

At least one radial water outlet opening can be configured in the sheath wall of the base element in the region of the bottom wall, and/or wherein at least three and preferably four spacer elements extending in the axial direction can be integrally formed on the stopper cap in the region of the bottom wall so as to be radially circumferential.

By providing a water outlet opening, water that penetrates into the receiving space via the actuation passage can be removed from the former.

Because hemispherical spacer elements are integrally formed on the bottom wall, water can also flow off in a fully screwed-together state. In particular, however, the spacer elements prevent the stopper cap from being screwed too tightly or completely onto the base element in such a way that it directly abuts the bottom wall.

An edge, preferably a radially circumferential edge, of the actuation passage can have a chamfer in the region of the stopper wall of the stopper cap.

Due to this chamfer, a scratching or die-like impression of the actuation passage on a component contacting the stopper wall, such as a hood or a tailgate or a counter-stopper element made of a soft component attached thereto [sic].

On a side of the bottom wall opposite the receiving space, a recess can be configured so as to be radially circumferential about the spreading vanes.

This recess prevents the spreading vanes from lifting the spacer apparatus in the fastened state from a surface of a carrier component to which the spacer apparatus is connected. The recess thus improves or enables a full-surface abutment of the bottom wall of the base element on a surface of a carrier component.

In addition, guiding tabs extending into the receiving space in the axial direction can be integrally formed on the bottom wall.

The guiding tabs enable a guiding and centering of the pin device and in this way prevent a false positioning of the pin device and a tilting or tipping of the latter upon actuation of the spacer apparatus.

The components of the spacer apparatus can be made of a plastic (hard component) by means of a single or multi-component injection molding method and, if applicable, made of a soft component with regionally integrally formed portions.

The spacer apparatus is preferably connected to a carrier component in an assembly direction that extends parallel to the axial direction or orthogonally to a surface of a carrier component that bounds a passage.

Furthermore, according to the present invention, a spacer system comprising the spacer apparatus described above and a counter-stopper element made of a soft component that can be fastened to a component, in particular a hood or a tailgate.

BRIEF DESCRIPTION OF THE DRAWINGS

The present invention will now be described in more detail on the basis of an exemplary embodiment shown in the figures. The figures show.

DETAILED DESCRIPTION

Figure 1:
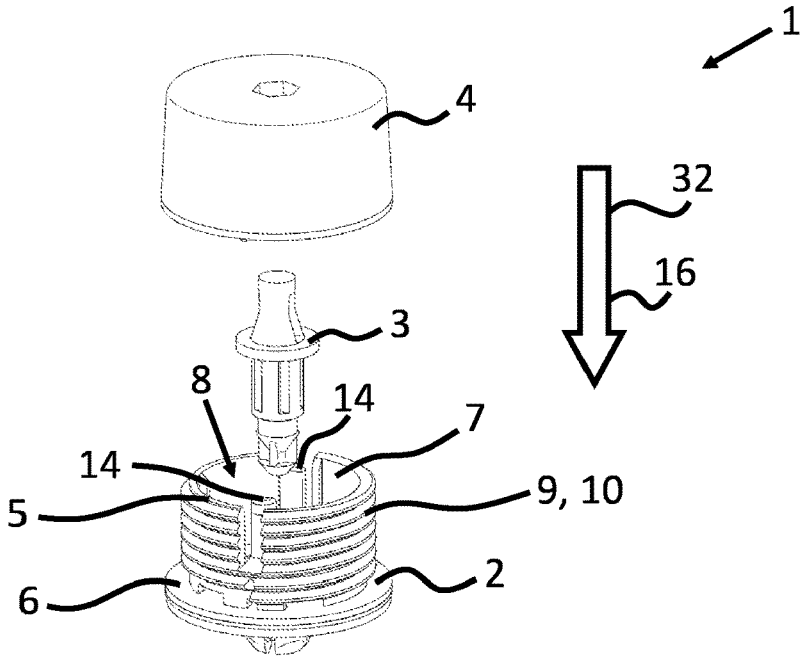
FIG. 1 a perspective exploded view of a spacer apparatus according to the invention according to a first exemplary embodiment, FIG. 2 a laterally cut view of the spacer apparatus, FIG. 3 a lateral view of the spacer apparatus in which a stopper cap is fully screwed onto a base element, FIG. 4 a laterally cut view of the spacer apparatus in which the stopper cap is arranged at a maximum possible distance from a bottom wall of the base element, FIG. 5 a laterally cut partial view of the spacer apparatus in a home position, FIG. 6 a lateral detail view of spacer elements of the spacer apparatus, FIG. 7 a plan view of the spacer apparatus from below, FIG. 8 a lateral view of the spacer apparatus, FIG. 9 a laterally cut view of the spacer apparatus, FIG. 10 a plan view of the spacer apparatus from above, FIG. 11 a perspective view of the pin element, FIG. 12 a lateral view of the base element, FIG. 13 a perspective view of the stopper cap, FIG. 14 a further perspective view of the stopper cap, FIG. 15 a perspective view of the base element, FIG. 16 a further perspective view of the base element, FIG. 17 a laterally cut view of the spacer apparatus according to a second exemplary embodiment, FIG. 18 a perspective view of the base element and the pin element, and FIG. 19 a further perspective view of the base element and the pin element.
Figure 2:
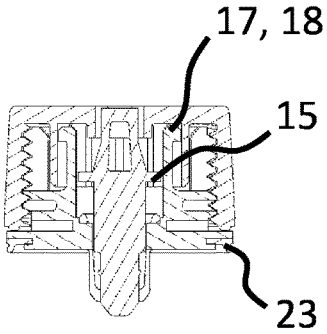
Figure 3:
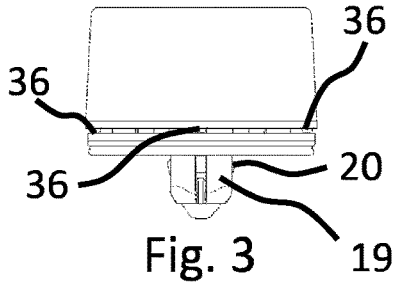
Figure 4:
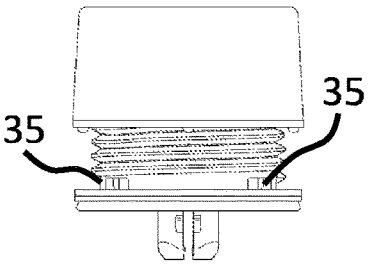
Figure 5:
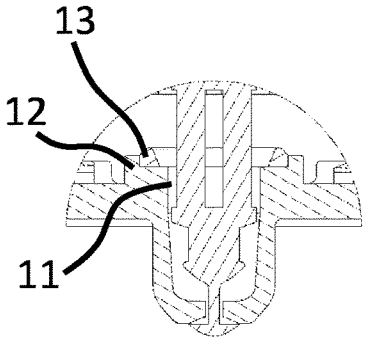
Figure 6:
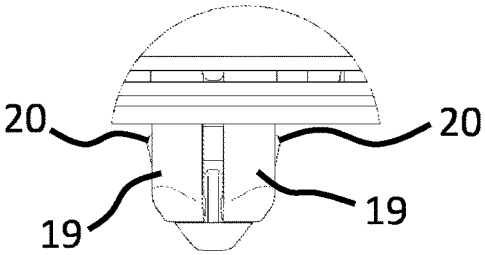
Figure 7:
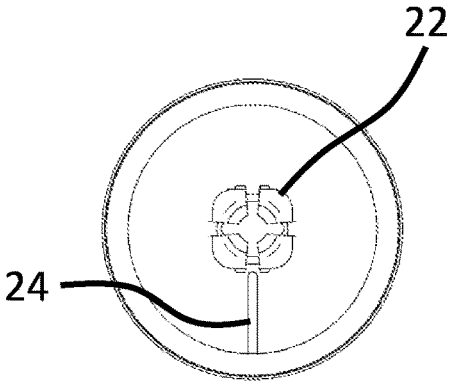
Figure 8:
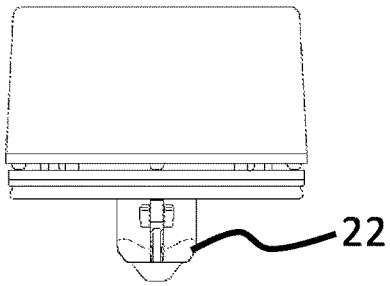
Figure 9:
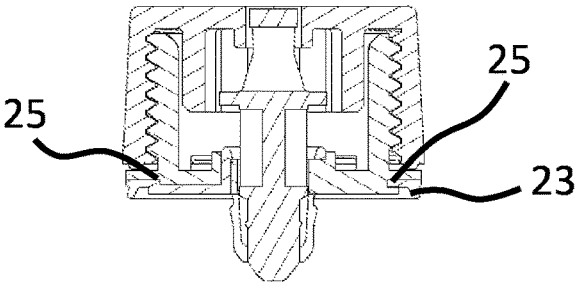
Figure 10:
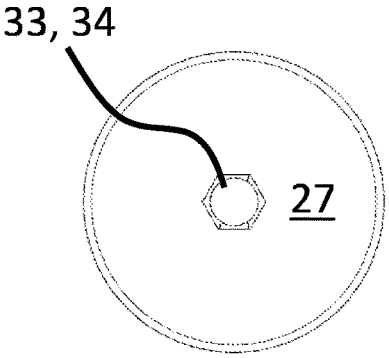
Figure 11:
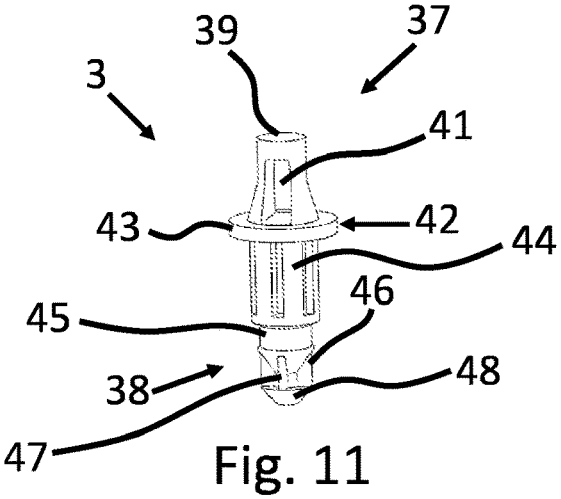
Figure 12:
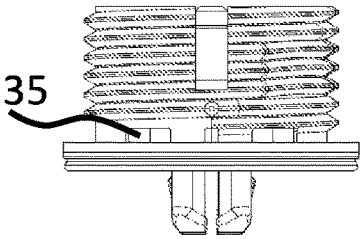
Figure 13:
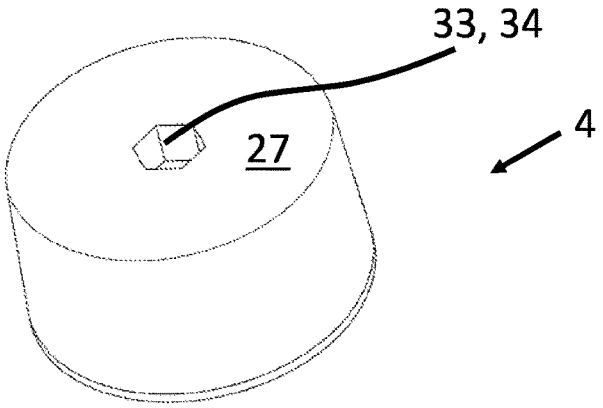
Figure 14:
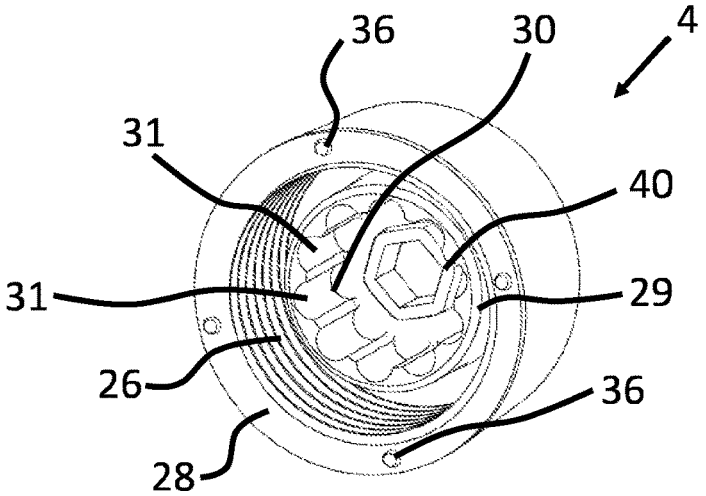
Figure 15:
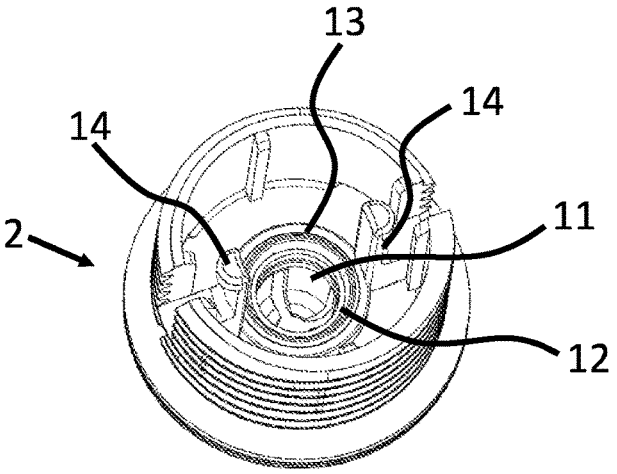
Figure 16:
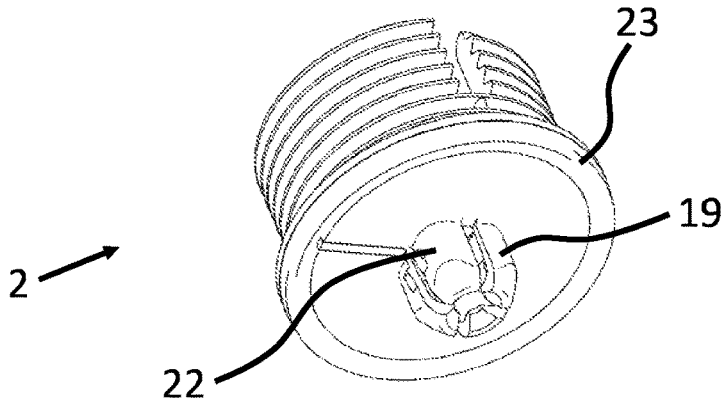

In the following, a spacer apparatus 1 according to the invention is described in further detail (FIGS. 1 to 16).

The spacer apparatus 1 comprises a base element 2, a pin element 3, and a stopper cap 4.

The base element 2 comprises a tubular sheath wall 5 and a flange-like bottom wall 6. An inner wall portion 7 of the sheath wall 5 bounds a receiving space 8.

An outer threading 10 is integrally formed on an outer wall portion 9 of the sheath wall 5, via which the base element 2 can be connected to the stopper cap 4.

In the bottom wall 6 of the base element 2, a pin passage 11 is configured. In the region of the receiving space 8, the pin passage 11 is bounded by a tubular guiding element 12. A sealing ring 13 is integrally formed on the guiding element, preferably by means of a 2-component injection molding process.

Furthermore, two diametrically opposed positioning means 14, which extend in the axial direction, are integrally formed on the bottom wall 6 in the region of the receiving space 8.

The positioning means 14 are approximately L-shaped, wherein a long leg 15 extends in the axial direction 16 and is connected to the bottom wall 6. A short leg 17 extends radially outward or orthogonally to the axial direction 16. At a free end of the short leg 17, an approximately semi-circular positioning element 18 is integrally formed in the plan view.

On a side of the bottom wall 6 opposite to the receiving space 8, spreading vanes 19 extending in the axial direction are integrally formed so as to be radially circumferential about the pin passage 11. Preferably, four spreading vanes 19 are provided, being radially circumferential and equally spaced apart from one another. Alternatively, three or five or more spreading vanes 19 can also be provided.

The spreading vanes 19 are preferably provided with securing elements 20 that extend radially outward. In particular, the spreading vanes 19, but preferably also the securing elements 20, form a fastening device of the spacer apparatus 1 for connecting to a passage (not shown) of a carrier component.

In the region of the bottom wall 6, the spreading vanes 19 or the fastening device 21 comprise an anti-rotation portion 22, which is approximately rectangular and preferably square. By means of the anti-rotation portion 22, the spacer apparatus 1 is secured against rotation, in particular when operating the stopper cap 4 or when rotating the same. The anti-rotation portion 22 thus forms an anti-rotation device.

On the side of the bottom wall 6 opposite the receiving space 8, a radially circumferential sealing lip 23 extending in the axial direction 16 is integrally formed at the edge of the bottom wall.

The sealing lip 23 is preferably also integrally connected to the bottom wall 6 by means of a 2-component injection molding method. For manufacturing reasons, the sealing lip is connected to the sealing ring 13 via a melt channel 24.

In addition, a sealing lip receptacle recess 25 extending inwardly in the radial direction can be provided on the bottom wall or on its radially circumferential edge. The sealing lip receptacle recess 25 facilitates the integral formation of the sealing lip 23 on the bottom wall 6.

For manufacturing reasons, the tubular sheath wall 5 can be interrupted in the region of the positioning means 14 by recesses extending in the axial direction. This may be necessary due to the use of sliding tools during the manufacture of the spacer apparatus. The positioning means 14 are arranged in the region of these recesses.

The stopper cap 4 is approximately bowl-shaped, wherein the stopper cap has an inner threading 26 via which the stopper cap 4 is connected to the base element 2.

Furthermore, the stopper cap 4 comprises a stopper wall 27 extending orthogonally to the axial direction 16.

The inner threading 26 is configured on an outer sheath wall 28 of the stopper cap 4. An inner positioning wall 29, also tubularly configured, is provided concentrically to the outer sheath wall 28.

On an inner wall 30 of the positioning wall, positioning recesses 31 are formed and are configured so as to be radially circumferential and equally spaced apart from one another and corresponding to the positioning elements 18 of the positioning means 14. The positioning recesses 31 are approximately semi-circular in cross-section.

Due to the fact that the positioning elements 18 of the positioning means 14 are engaged with the positioning recesses 31 of the stopper cap 4, the stopper cap 4 is fixed in place against rotation about a longitudinal axis 32. By applying a predetermined force in a direction of rotation about the longitudinal axis 32, the long legs 15 of the positioning means 14 are bent radially inward, and the positioning elements 31 jump into the subsequent positioning recesses 31 accordingly.

Approximately centrally in the stopper wall 27 of the stopper cap 4, an actuation passage 33 is configured. The actuation passage 33 also has a drive 34 in that it comprises a hexagonal shape in cross-section in such a way that an Allen drive 34 is formed by the actuation passage 33.

In the sheath wall 5 of the base element 2, a plurality of water outlet openings 35 are configured so as to be radially circumferential in the region of the bottom wall 6.

Four spacer elements 36, which extend radially in the axial direction 16 and are approximately semi-circular, are integrally formed on the stopper cap 4 in the region of the bottom wall 6.

The pin element 3 comprises a head portion 37 and a shaft portion 38.

An actuation surface 39, which extends orthogonally to the axial direction 16, is provided on the head portion 37 in order to displace the pin element 3 in the axial direction 16 by means of a tool.

The actuation surface 39 is arranged in a home position in the region of an annular portion 40 extending into the receiving space 8, which bounds the actuation passage 33. The annular portion 40 has a hexagonal shape in cross-section and thus also forms the Allen drive 34.

Adjacent to the actuation surface 39, a passage recess 41 extending orthogonally to the axial direction 16 is configured in the head portion. With the stopper cap 4 unscrewed, a tool can be arranged in the passage recess 41 in order to displace the pin element 3 in the axial direction 16.

In a transition region 42 from the head portion 37 to the shaft portion 38, a radially circumferential circular disk-shaped sealing portion 43 can be provided. In a final assembly position, the sealing portion 43 sealingly rests on the sealing ring 13 of the base element 2.

Adjacent to the sealing portion 43, an approximately cylindrical guiding portion 44 is configured. The cylindrical guiding portion 44 is guided in the tubular guiding element 12 of the base element in the axial direction 16 and thus prevents the pin element from being tilted and ensures clean guiding of the same in the axial direction 16.

Adjacent to the guiding portion 44, a cylindrical securing portion 45 is provided on the pin element 3. In a final assembly position, the securing portion 45 holds the spreading vanes 19 or applies a force in the radial direction outwardly in such a way that the spacer apparatus 1 can be securely and reliably assembled or fastened in a passage of a carrier component.

Adjacent to the securing portion 45, a transport securing portion 46 is provided for securing the pin element 3 in a home position.

The transport securing portion 46 comprises securing blades 47 that are radially circumferential and equally spaced apart from one another and extend in the axial direction. Four securing blades 47 are provided, wherein the number of securing blades 47 corresponds to the number of spreading vanes 19. The securing blades 47 are arranged in the home position and transport position between the spreading vanes 19 of the fastening device 21 and secure the pin element 3 against sliding in the axial direction 16.

Adjacent to the transport securing portion 46, a cone-shaped insert portion 48 is provided.

In the following, a method for assembling the spacer apparatus according to the invention is briefly described.

First, the spreading vanes 19 are inserted into a passage of a carrier component in such a way that the latching elements 20 engage with a corresponding edge of the passage. The spacer apparatus 1 is arranged in a rotation-proof manner in the passage via the anti-rotation portion 22.

Subsequently, the actuation surface 39 of the pin element is subjected to a force in the axial direction 16 in such a way that the securing blades 47 are displaced from the region between the spreading vanes 19 in the axial direction 16, wherein the spreading vanes 19 are bent outwardly in the radial direction by the securing portion 45 of the pin element 3, and wherein the securing portion 45 simultaneously secures the spreading vanes 19 against a movement inwardly in the radial direction, i.e., prevents them from doing so.

The sealing portion 43 of the pin element 3 then also abuts the sealing ring 13 of the base element 2 in a sealing manner.

A distance or spacing between the stopper wall 27, the stopper cap 4, and the bottom wall 6 can be preset immediately after manufacture.

For this purpose, the stopper cap 4 is preferably offset about the longitudinal axis 32 in a rotational movement by means of a tool, for example an Allen key, which is arranged in the Allen drive 34, until the desired distance or spacing between the bottom wall 6 and the stopper wall 27 is achieved.

The bottom wall 6 is sealingly connected to the surface of a carrier component via the sealing lip 23.

In order to release the spacer apparatus 1, only the stopper cap 4 has to be unscrewed from the base element 2. Subsequently, a tool can be inserted laterally into the passage 41 of the pin element 3, and the latter can then be displaced with a type of levering movement in the axial direction 16 in such a way that the securing portion 45 is moved out of the region of the spreading vanes 19.

The spreading vanes 19 thereby move inwardly in a radial direction, wherein the securing blades 47 are then arranged again in the region between the spreading vanes 19.

Figure 17:
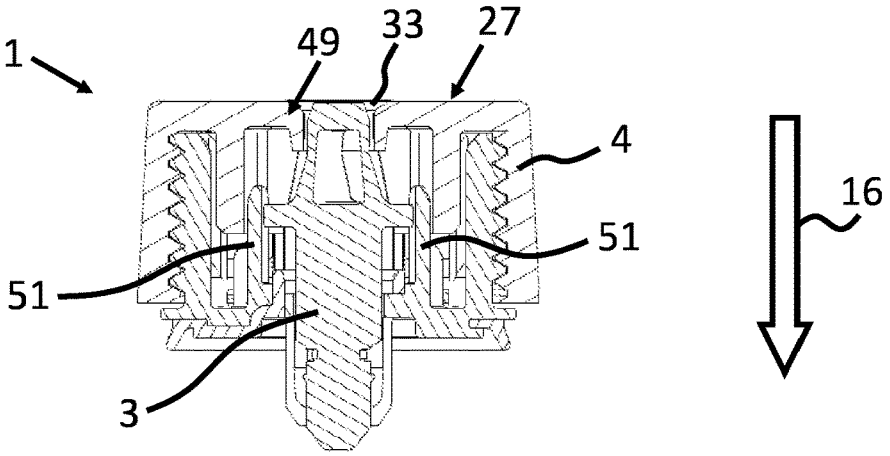
Figure 18:
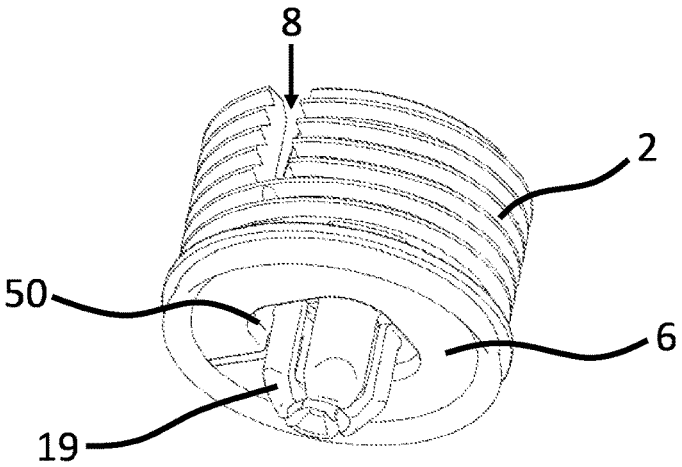
Figure 19:
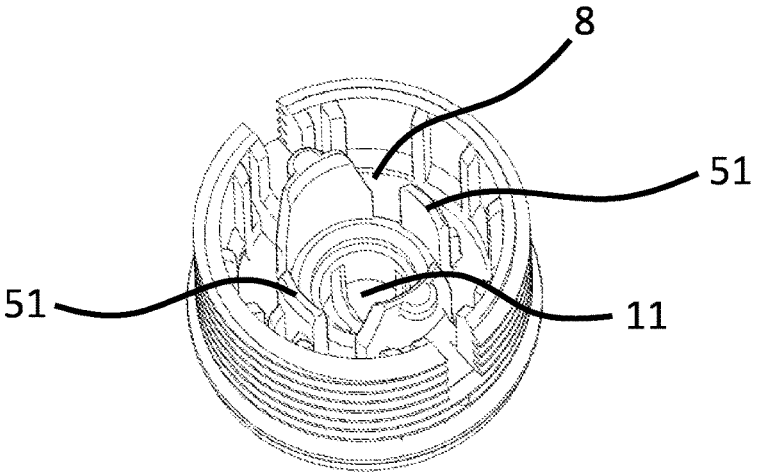

A spacer apparatus 1 according to the invention according to a second exemplary embodiment is described in further detail below (FIGS. 17 to 19).

The spacer apparatus 1 according to the second exemplary embodiment substantially corresponds to the spacer apparatus 1 according to the first exemplary embodiment or constitutes a further development of this spacer apparatus 1. Unless described otherwise, the spacer apparatus 1 according to the second exemplary embodiment has the same technical features as the spacer apparatus 1 according to the first exemplary embodiment. The same technical features bear the same reference numerals. The technical features of the two exemplary embodiments can be combined as desired with one another.

According to the second exemplary embodiment, the actuation passage 33 of the stopper cap 4 is inclined or chamfered, i.e., provided with a chamfer 49 in the region of the stopper wall 27.

Due to the chamfer 49, it is prevented that a component contacting the stopper wall 27 or a region contacting the same is scratched. Because chamfer 49 is provided, there is no stamp impression of the actuation passage 33 or the drive 34 on a component contacting the stopper wall 27.

On a side of the bottom wall 6 opposite the receiving space 8, a recess 50 is configured, which is configured so as to be radially circumferential about the spreading vanes 19 and, in a plan view from below, approximately rectangular or corresponding to the cross-section of the spreading vane 19.

The recess 50 prevents the spreading vanes 19 from lifting the spacer apparatus 1 in the latched or fastened state from a surface of a carrier component upon connection to a passage of a carrier component. The recess 50 thus ensures that the bottom wall 6 rests fully on a carrier component connected thereto.

In this way, an exact positioning of the spacer apparatus 1 on a carrier component is enabled, so that the spacer apparatus can be fixed approximately orthogonally to the surface of a carrier component.

In the region between the two positioning means 14, two guiding tabs 51 are arranged diametrically opposite to one another. The guiding tabs are integrally formed on the bottom wall 6 and extend into the receiving space 8 in the axial direction 16. The guiding tabs 51 are approximately plate-shaped and, in a plan view, have a curvature corresponding to the pin passage 11.

The pin element 3 is guided in the axial direction 16 by the guiding tabs 51, which are diametrically opposite to one another. Upon a use of the spacer apparatus 1, the guiding tabs 51 prevent the pin device from tilting. Accordingly, the guiding tabs 51 form a centering device for the pin element 3.

The spacer apparatus according to the second embodiment thus substantially corresponds to the spacer apparatus according to the invention according to the first embodiment, wherein the chamfer 49, recess 50, and guiding tabs 51 are additionally provided with the described technical effects.

The base element 2, the pin element 3, and the stopper cap 4 of the spacer apparatus 1 are configured from a plastic made of a hard component and manufactured by means of an injection molding process. Corresponding plastic sealing elements are formed from a soft component and can be manufactured and molded in a single pass by a 2-component injection molding process.

LIST OF REFERENCE NUMERALS

1 Spacer apparatus
2 Base element
3 Pin element
4 Stopper cap

5 Tubular sheath wall
6 Bottom wall
7 Inner wall portion
8 Receiving space
9 Inner wall portion
10 Outer thread
11 Pin passage
12 Tubular guiding element
13 Sealing ring
14 Positioning means
15 Long leg
16 Axial direction
17 Short leg
18 Positioning element
19 Spreading vane
20 Latching element
21 Fastening device
22 Anti-rotation portion
23 Sealing lip
24 Melt channel
25 Sealing lip receptacle recess
26 Inner thread
27 Stopper wall
28 Outer sheath wall
29 Positioning wall
30 Inner wall
31 Positioning recess
32 Longitudinal axis
33 Actuation passage
34 Allen drive
35 Water outlet opening
36 Spacer element
37 Head portion
38 Shaft portion
39 Actuation surface
40 Annular portion
41 Passage recess
42 Transition region
43 Sealing portion
44 Guiding portion
45 Securing portion
46 Transport securing portion
47 Securing blade
48 Insert portion
49 Chamfer
50 Recess
51 Guiding tabs

The invention claimed is:

1. A spacer apparatus, comprising a base element having a tubular sheath wall and a bottom wall, wherein an inner wall portion of the sheath wall bounds a receiving space, and wherein a pin passage is configured in the bottom wall, wherein a fastening device is provided on the side of the bottom wall opposite the sheath wall for connecting the spacer apparatus to a carrier component, and a pin element arranged in the receiving space for actuating the fastening device that extends through the pin passage, and a stopper element, wherein the stopper element and the sheath wall of the base element are rotatably connected to one another via a threaded connection in which the stopper element is directly threaded to the tubular sheath wall.

2. The spacer apparatus according to claim 1, wherein an outer threading is integrally formed on an outer wall portion of the sheath wall of the base element, and wherein the stopper element comprises an inner threading that is engaged with the outer threading of the base element, wherein the stopper element comprises a stopper wall extending orthogonally to an axial direction, and wherein the stopper element and the fastening device are arranged so as to be approximately flush with one another in the axial direction.

3. The spacer apparatus according to claim 1, wherein at least two positioning means, which are configured in the manner of a latching element and extend into the receiving space in the axial direction, are arranged on the bottom wall, wherein the stopper element comprises a tubular inner positioning wall, wherein positioning recesses, which are configured so as to be radially circumferential and so as to correspond to the positioning means, are arranged on an inner wall of the tubular positioning wall in order to secure the stopper element against a rotation relative to the base element.

4. The spacer apparatus according to claim 1, wherein the fastening device is formed by spreading vanes, which are arranged so as to be radially circumferential about the pin passage and are spreadable by means of the pin element, wherein the spreading vanes form an approximately rectangular anti-rotation portion in the region of the bottom wall, and wherein latching elements extending outwardly in the radial direction are integrally formed on the spreading vanes in order to hold the spacer apparatus in a pre-assembly position in a carrier component.

5. The spacer apparatus according to claim 1, wherein the pin element comprises a head portion and a shaft portion, wherein an actuation surface extending orthogonally to the axial direction is provided on the head portion in order to displace the pin element in the axial direction, and/or wherein a recess extending orthogonally to the axial direction is configured in the head portion for detaching the fastening device by means of a tool, and/or wherein a radially circumferential circular disk-shaped sealing portion is provided in a transition region from the head to the shaft portion, and/or wherein an approximately cylindrical guiding portion is provided adjacent to the sealing portion for guiding the pin element in the pin passage, and/or wherein a cylindrical securing portion is provided adjacent to the guiding portion for securing the spreading vanes in a spread-open final assembly position, and/or wherein a transport securing portion is provided adjacent to the securing portion for securing the pin element in a home position, and/or wherein a conical insert portion is provided adjacent to the transport securing portion.

6. The spacer apparatus according to claim 1, wherein an actuation passage is configured centrally in the stopper surface in order to displace the pin element in the axial direction by means of a tool, wherein the actuation passage is bounded by an annular portion extending into the receiving space, and wherein the head portion of the pin element in the home position is arranged regionally in the actuation passage, and the actuation passage forms a drive.

7. The spacer apparatus according to claim 1, wherein a sealing ring is arranged on the bottom wall in the receiving space so as to be radially circumferential about the pin passage, to which sealing ring the sealing portion of the pin element abuts sealingly in an assembly position, and/or wherein a sealing lip extending radially circumferentially in the axial direction is integrally formed on the side of the bottom wall opposite the sheath wall, wherein the sealing ring and the sealing lip are formed from a soft component and are manufactured together with the base element by means of a 2-component injection molding process.

8. The spacer apparatus according to claim 1, wherein the transport securing portion of the pin element comprises securing blades that are radially circumferential and equally spaced apart from one another and extend in the axial direction, wherein the securing blades are arranged in the home position between the spreading vanes of the fastening device and secure the pin element against a displacement in the axial direction, and wherein the number of securing blades corresponds to the number of spreading vanes.

9. The spacer apparatus according to claim 1, wherein regions of a threading of the base element have a pitch that is different from remaining regions of the threading of the base element, in such a way that curved portions are configured in the threading of the base element in order to tense a threading of the stopper element with the threading of the base element.

10. The spacer apparatus according to claim 1, wherein at least one water outlet opening is configured in the sheath wall of the base element in the region of the bottom wall, and/or wherein at least three spacer elements extending in the axial direction are integrally formed on the stopper element in the region of the bottom wall so as to be radially circumferential.

11. A spacer apparatus, comprising a base element having a tubular sheath wall and a bottom wall, wherein an inner wall portion of the sheath wall bounds a receiving space, and wherein a pin passage is configured in the bottom wall, wherein a fastening device is provided on the side of the bottom wall opposite the sheath wall for connecting the spacer apparatus to a carrier component, and a pin element arranged in the receiving space for actuating the fastening device that extends through the pin passage, and a stopper element, wherein the stopper element and the sheath wall of the base element are rotatably connected to one another via a threaded connection;

wherein at least two positioning means, which are configured in the manner of a latching element and extend into the receiving space in the axial direction, are arranged on the bottom wall;

wherein the stopper element comprises a tubular inner positioning wall, wherein positioning recesses, which are configured so as to be radially circumferential and so as to correspond to the positioning means, are arranged on an inner wall of the tubular positioning wall in order to secure the stopper element against a rotation relative to the base element.

12. A spacer apparatus, comprising a base element having a tubular sheath wall and a bottom wall, wherein an inner wall portion of the sheath wall bounds a receiving space, and wherein a pin passage is configured in the bottom wall, wherein a fastening device is provided on the side of the bottom wall opposite the sheath wall for connecting the spacer apparatus to a carrier component, and a pin element arranged in the receiving space for actuating the fastening device that extends through the pin passage, and a stopper element, wherein the stopper element and the sheath wall of the base element are rotatably connected to one another via a threaded connection;

wherein a threading of the base element includes a region have a pitch that is different from remaining regions of the threading of the base element, such that curved portions are configured in the threading of the base element in order to tense a threading of the stopper element with the threading of the base element.

* * * * *